US012637796B2

(12) United States Patent
Roetker et al.

(10) Patent No.: US 12,637,796 B2
(45) Date of Patent: May 26, 2026

(54) LAUNDRY SYSTEM AND METHOD TO REDUCE TEXTILE MICROFIBER RELEASE

(71) Applicant: Haier US Appliance Solutions, Inc., Wilmington, DE (US)

(72) Inventors: John Joseph Roetker, Louisville, KY (US); Otto Armando Ramirez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 178 days.

(21) Appl. No.: 18/492,223

(22) Filed: Oct. 23, 2023

(65) Prior Publication Data

US 2025/0129531 A1 Apr. 24, 2025

(51) Int. Cl.

| | |
|---|---|
| ***D06F 25/00*** | (2006.01) |
| ***D06F 33/56*** | (2020.01) |
| ***D06F 33/63*** | (2020.01) |
| ***D06F 37/38*** | (2006.01) |
| ***D06F 58/22*** | (2006.01) |
| *D06F 103/38* | (2020.01) |
| *D06F 103/54* | (2020.01) |
| *D06F 105/32* | (2020.01) |
| *D06F 105/46* | (2020.01) |
| *D06F 105/48* | (2020.01) |

(52) U.S. Cl.

CPC ..... *D06F 33/56* (2020.02); *D06F 25/00* (2013.01); *D06F 33/63* (2020.02); *D06F 37/38* (2013.01); *D06F 58/22* (2013.01); *D06F 2103/38* (2020.02); *D06F 2103/54* (2020.02); *D06F 2105/32* (2020.02); *D06F 2105/46* (2020.02); *D06F 2105/48* (2020.02)

(58) Field of Classification Search

None

See application file for complete search history.

(56) References Cited

U.S. PATENT DOCUMENTS

2004/0129032 A1* 7/2004 Severns ..... C11D 3/3765 68/23.5
2005/0071929 A1* 4/2005 Mani ..... D06F 25/00 68/19

FOREIGN PATENT DOCUMENTS

| | | | |
|---|---|---|---|
| CN | 113215766 | A | 8/2021 |
| DE | 102020100759 | A1 | 7/2021 |
| DE | 102020118877 | A1 | 1/2022 |
| KR | 20060065266 | A | 6/2006 |
| WO | WO2019137210 | A1 | 7/2019 |

* cited by examiner

*Primary Examiner* — Levon J Shahinian
(74) *Attorney, Agent, or Firm* — Dority & Manning, P.A.

(57) ABSTRACT

A laundry appliance and a method of operating the laundry appliance to reduce textile microfiber release includes performing an air wash cycle of a load of laundry articles before performing a wet wash cycle of the laundry load. The air wash cycle includes operating a fan to circulate an airflow through a laundry basket containing a load of laundry articles to release microfibers from the articles. A wet wash cycle follows the dry wash cycle, the wet wash cycle introduces a wash fluid to the load of laundry articles.

17 Claims, 5 Drawing Sheets

LAUNDRY SYSTEM AND METHOD TO REDUCE TEXTILE MICROFIBER RELEASE

FIELD OF THE INVENTION

The present disclosure relates generally to laundry appliances, more specifically to methods of operating a combination washer/dryer laundry appliance to reduce the level of microfiber released during a laundry process.

BACKGROUND OF THE INVENTION

Typical laundry articles are formed from textile fabrics and, accordingly, comprise various fibers twisted into yarns or threads and woven to form fabric. Fiber fragments, or microfibers, may remain in or on the fabric from the manufacturing process. During laundry processes, the microfibers may be released from the fabric, for example during agitation in a wash cycle. Further, the wash cycle may create additional fiber fragments as the agitation of the cycle causes interfacial scrubbing of fabrics against itself or other fabric articles in the laundry load. The microfibers may be passed to wastewater and can enter the food chain through marine and terrestrial ecosystems.

Environmental concerns, standards, and some regulations call for reduced emission of microfibers to the environment. Filtering of wastewater, also known as wet filtering, encounters several challenges with clogging filters, difficulty removing wet fiber debris from the filter, and trapping of the released fibers in the laundry appliance. Accordingly, improvements to laundry appliances and methods that reduce the release of microfibers to wastewater and improve the capture of released microfibers may be beneficial.

BRIEF DESCRIPTION OF THE INVENTION

Aspects and advantages of the invention will be set forth in part in the following description, may be apparent from the description, or may be learned through practice of the invention.

In one exemplary aspect, a laundry appliance includes a tub positioned within a cabinet, a basket supported for rotation within the tub, the basket defining a chamber for receipt of laundry articles for washing and drying, an air duct system providing fluid communication between an air inlet, the chamber, and an air outlet, wherein the air inlet, the chamber, and the air outlet define an air flow path, a fan operable to move a flow of air through the air flow path; and a controller operably coupled to a drive motor and the fan. The controller is configured to perform an air wash cycle on a load of laundry articles, wherein the air wash cycle comprises operating the fan to circulate air within the air duct system, and perform a wet wash cycle on the load of laundry articles, wherein the wet wash cycle comprises introducing wash fluid into the tub wherein the wet wash cycle is performed immediately following the air wash cycle.

In another exemplary aspect, a method of operating a laundry appliance is presented. The laundry appliance comprises a basket defining a chamber, the basket supported for rotation within a tub, a drive motor operatively coupled to the basket, an air duct system providing fluid communication between an air inlet, the chamber, and an air outlet, wherein the air inlet, the chamber, and the air outlet define an air flow path, and a fan operable to move a flow of air through the air flow path. The method comprises performing an air wash cycle on a load of laundry articles, wherein the air wash cycle comprises operating the fan to circulate air within the air duct system, and performing a wet wash cycle on the load of laundry articles, wherein the wet wash cycle comprises introducing wash fluid into the tub, wherein the wet wash cycle is performed immediately following the air wash cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
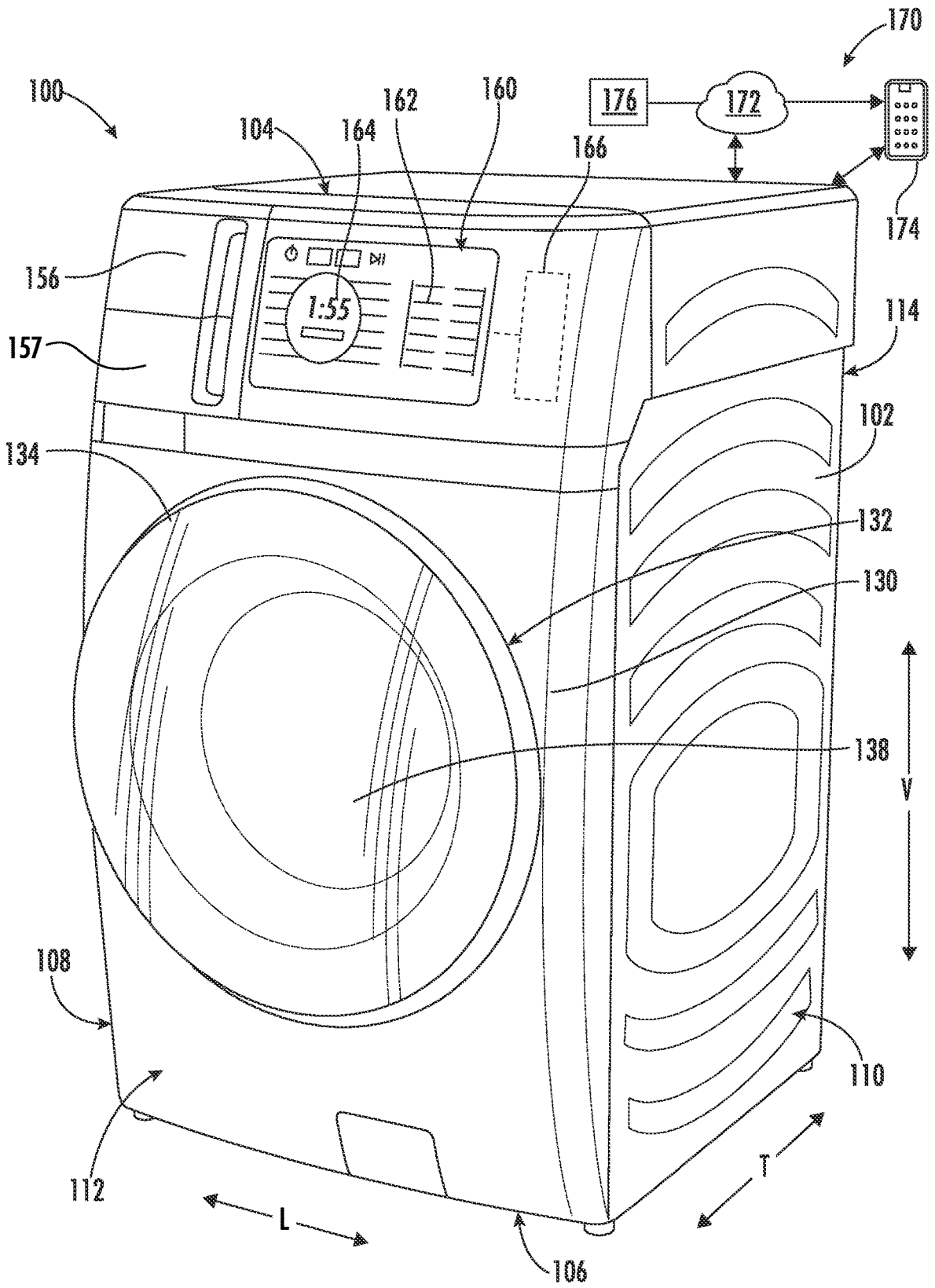
FIG. 1 provides a perspective view of a combination washer/dryer laundry appliance in accordance with exemplary embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
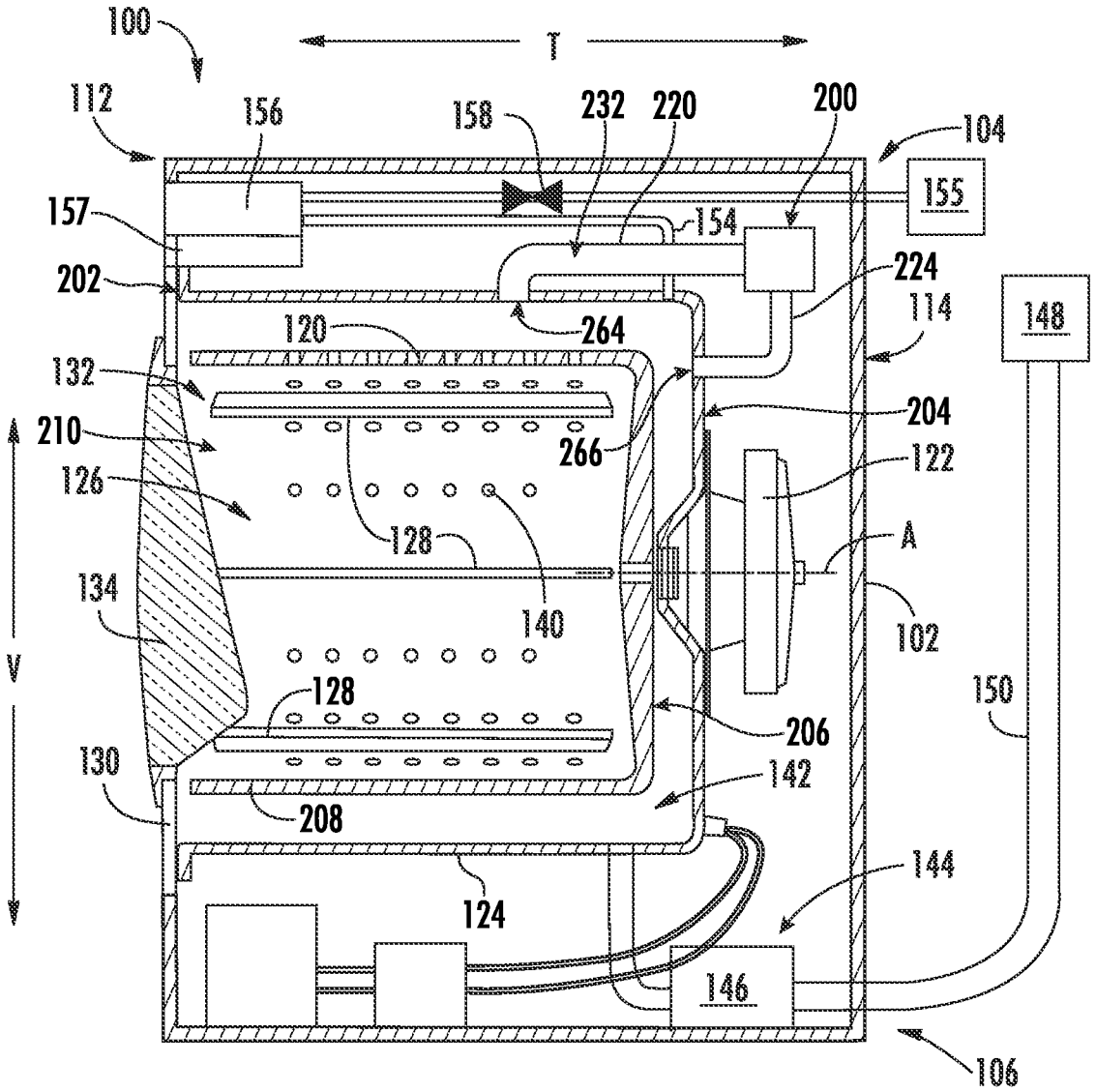
FIG. 2 provides a side cross-sectional view of the exemplary laundry appliance of FIG. 1.

Turning to the figures, FIG. 1 is a perspective view of an exemplary horizontal axis washer and condenser dryer combination appliance 100, referred to herein for simplicity as laundry appliance 100. Although described in reference to a combination washer and condenser dryer, one of ordinary skill in the art will recognize that the present disclosure may be practiced in any combination washer and dryer laundry appliance, including laundry appliance that may be vented to the outside. FIG. 2 is a side cross-sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction L, and between a front 112 and a rear 114 along the transverse direction T.

In the exemplary embodiment of FIG. 2, a laundry basket 120 is rotatably mounted (i.e., supported for rotation) within cabinet 102 such that it is rotatable about an axis of rotation A. According to the illustrated embodiment, axis of rotation A is substantially parallel to the horizontal direction (e.g., the transverse direction T), as this exemplary appliance is a front load appliance. A drive motor 122, e.g., such as a pancake motor, is in mechanical communication with laundry basket 120 to selectively rotate laundry basket 120 (e.g., in an air wash cycle, a wash cycle, or a dry cycle of laundry appliance 100) under the control of controller 166. Drive motor 122 may be mechanically coupled to laundry basket 120 directly or indirectly, e.g., via a pulley and a belt (not pictured). Laundry basket 120 is received within a tub 124 that defines a chamber 126 configured for receipt of articles for washing or drying.

As used herein, the terms "clothing" or "articles" includes but need not be limited to fabrics, textiles, garments, linens, or other items comprised of threads or yarns that may be subject to laundering processes. Furthermore, the term "load" or "laundry load" refers to the combination of articles that may be treated together in laundry appliance 100, and may include a mixture of different or similar articles of clothing, made from different or similar types and kinds of fabrics, textiles, and linens within a particular laundering process.

In exemplary laundry appliance 100, the tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of ribs 128 extend from basket 120 into chamber 126. In this manner, for example, ribs 128 may lift articles disposed in laundry basket 120 and then allow such articles to tumble back to the bottom of laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 also includes a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIGS. 1 and 2) prohibiting access to tub 124. Laundry appliance 100 may further include a latch assembly (not shown) that is mounted to cabinet 102 and/or door 134 for selectively locking door 134 in the closed position. The latch assembly may be desirable, for example, to ensure only secured access to chamber 126 or to otherwise ensure and verify that door 134 is closed during certain operating cycles or events.

A window 138 in door 134 permits viewing of laundry basket 120 when door 134 is in the closed position, e.g., during operation of laundry appliance 100. Further, although door 134 is illustrated as mounted to front panel 130, it should be appreciated that door 134 may be mounted to another side of cabinet 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at the bottom of tub 124 along the vertical direction V. Thus, sump 142 is configured for receipt of and generally collects wash fluid during operation of laundry appliance 100 during a wet wash cycle. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124 during a wet wash cycle. For example, spout 154 may be in fluid communication with a water supply 155 in order to direct or introduce wash fluid into tub 124 for a typical wash or rinse cycle. Spout 154 may also be in fluid communication with the sump 142. For example, pump assembly 144 may direct wash fluid collected in sump 142 to spout 154 in order to circulate wash fluid in tub 124.

As illustrated in FIGS. 1 and 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130 as illustrated in FIG. 1. Control panel 160 and input selectors 162 collectively form a user interface input for operator selection of machine cycles and features. For example, in one embodiment, a display 164 indicates selected features, a countdown timer, and/or other items of interest to machine users.

Operation of laundry appliance 100 is controlled by a controller or processing device 166 (FIG. 1) that is operatively coupled to control panel 160 for user manipulation to select laundry cycles and features. The controller 166 may be operably coupled to mechanical and electrical components of the laundry appliance 100. In response to user manipulation of control panel 160, controller 166 operates the various components of laundry appliance 100 to execute selected machine cycles and features. For example, the controller 166 may be operably coupled to the motor 122 to rotate the basket 120 during a drying cycle.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and a laundry process is initiated. According to embodiments of the present disclosure, an air wash cycle may be the first cycle of the laundry process. The air wash cycle is initiated through operator manipulation of input selectors 162 and may be a default operation of some wash cycles or may be a user selected optional cycle. In the air wash cycle, following introduction of the laundry items and closing the door 134, the laundry basket 120 is rotated with a flow of filtered air passing through the tumbling dry laundry load. In an embodiment as will be described below, a forced air recirculation system draws a flow of air from the laundry basket 120, filters the air flow, and recirculates the filtered air to the laundry basket 120. In the process, human hair, pet hair, fibrous debris, such as grass, and microfibers are released from the laundry articles and captured by the filter. As will be discussed below, microfibers are pieces of the fiber from the threads and yarns used in making the laundry articles.

The wet washing cycle or operation follows the air was cycle and may also be initiated through operator manipulation of input selectors 162. In the wet was cycle, tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the number of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, and/or rinsed, combination appliance 100 can be operated to dry the laundry articles as will be discussed in greater detail below. Alternately, the user can remove the articles from laundry basket 120, e.g., by opening door 134 and reaching into laundry basket 120 through opening 132.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100. An exemplary use of the external communication system 170 includes user selection of the dry wash cycle for a laundry operation.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, e.g., directly through a local area network (LAN), Wi-Fi, Bluetooth, Zigbee, etc. or indirectly through network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with laundry appliance 100 and/or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
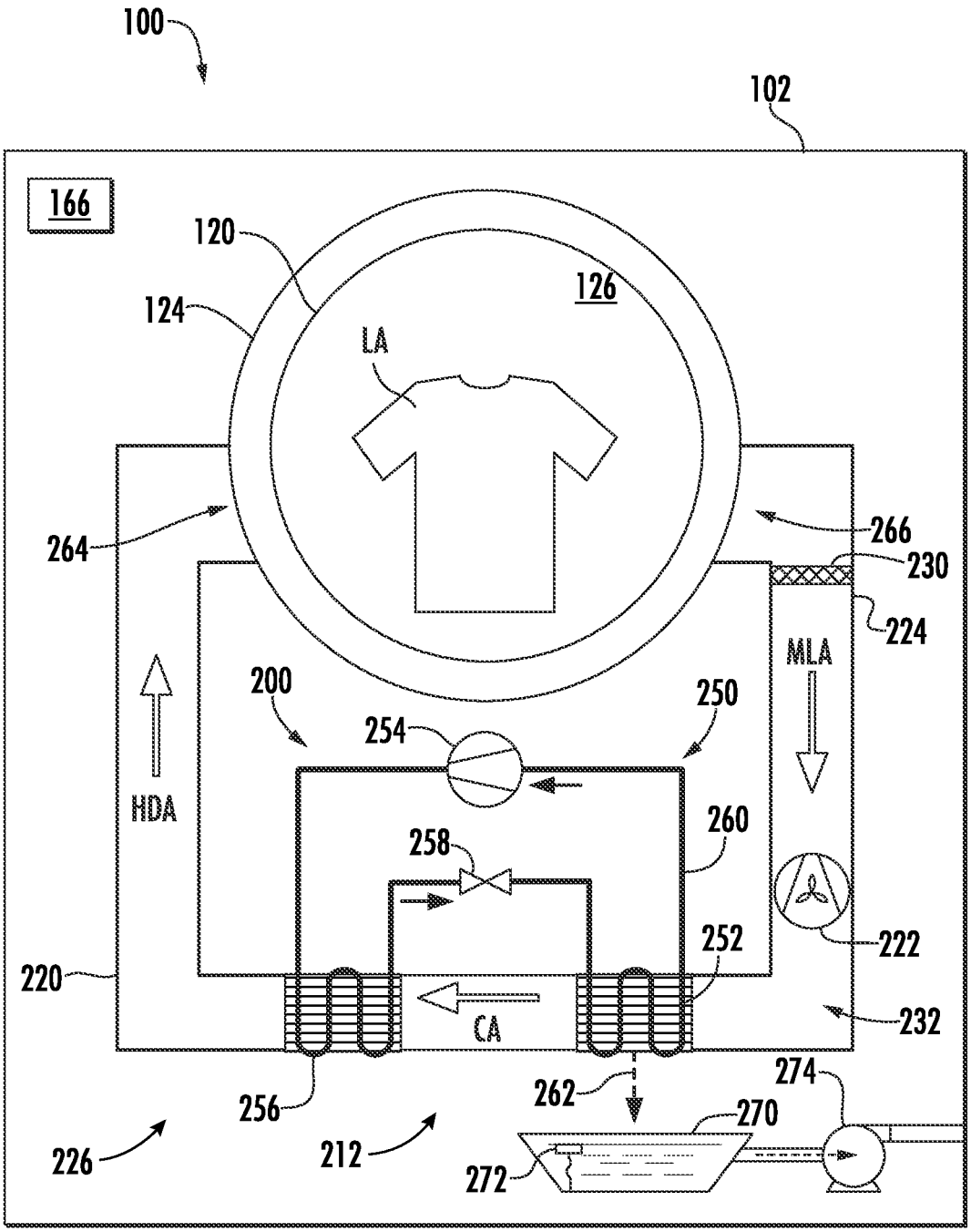
FIG. 3 provides a schematic diagram of an exemplary condenser dryer appliance and a conditioning system thereof in accordance with exemplary embodiments of the present disclosure.
Figure 4:
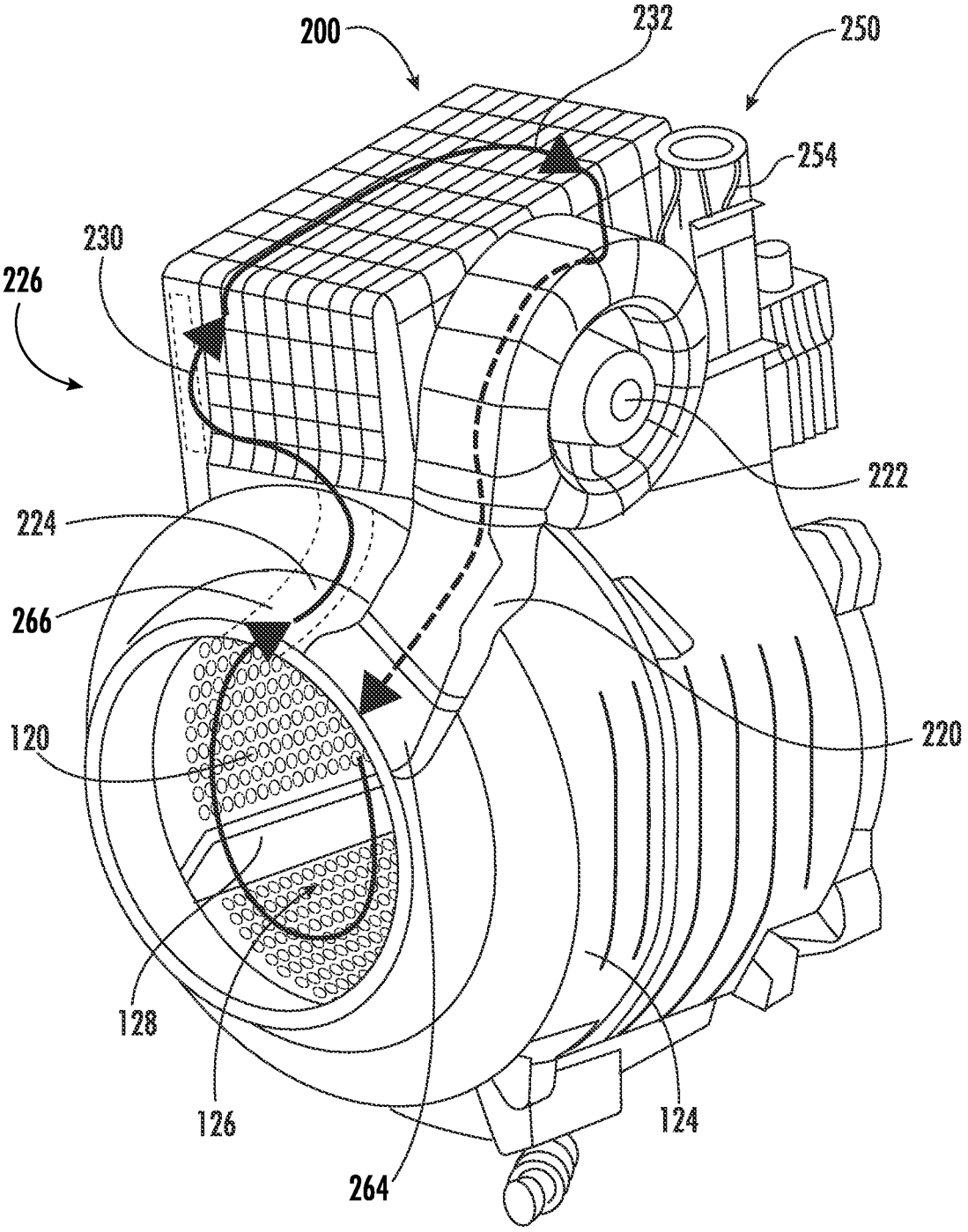
FIG. 4 provides a perspective view of the example laundry appliance of FIG. 1 with a cabinet of the laundry appliance removed to reveal certain components of the dryer appliance.

Referring now specifically to FIGS. 2 through 4, features of a forced air circulation system and a heat pump system, a condenser system, a refrigerant-based air conditioning system, a heat exchanger, or another suitable conditioning system 200 for facilitating a drying process within laundry appliance 100 will be described in more detail. The recirculating or ventless conditioning systems 200 discussed here are presented as an example only. Embodiments of the laundry appliance 100 may have an air intake and an external vent as is known in the art. The components of the conditioning system 200 and the cooperating intake duct 224 and return duct 220 may be used during the air wash cycle to provide unconditioned air (i.e., not dehumidified or heated) to the basket as will be apparent form the discussion below.

The controller 166 may be operably coupled to the conditioning system 200 to control the drying process by selectively operating the conditioning system 200 components (e.g., the evaporator 252 and the condenser 256) and the blower fan 222. For example, the controller 166 may energize the evaporator 252 and the condenser 256 of the conditioning system 200 during portions of the drying process, in cooperation with selective energizing of the blower fan 222, to dry damp laundry articles. As illustrated, conditioning system 200 may be mounted to tub 124 such that it is fluidly coupled to chamber 126. Laundry basket 120 includes a back or rear wall 206, e.g., at back portion of laundry basket 120 or proximate back portion 204 of tub 124. Rear wall 206 of laundry basket 120 may be rotatably supported within cabinet 102 by a suitable bearing.

Laundry basket 120 is generally cylindrical in shape having an outer cylindrical wall 208 and a front flange or wall that defines an opening 210 of laundry basket 120, e.g., at front portion 202 of laundry basket 120. As shown, opening 210 generally coincides with opening 132 of front panel 130 of cabinet 102, e.g., to provide user access to chamber 126 for loading and unloading of articles into and out of chamber 126 of laundry basket 120.

Conditioning system 200 may generally include a return duct 220 that is mounted to tub 124 for circulating process air (i.e., air used in a laundry process, for example the air wash cycle or the drying cycle) within chamber 126. For example, according to the illustrated exemplary embodiment, return duct 220 is fluidly coupled to tub 124 proximate a top of tub 124 (FIG. 2). Return duct 220 receives process air that has passed through the conditioning system 200, the heat exchanger 212 comprising evaporator 252 and condenser 256. The evaporator 252 corresponds to a dehumidification section and the condenser 256 corresponds to a heating section of the conditioning system 200. The return duct 220 provides the process air to laundry basket 120 via one or more holes defined by rear wall 206 and/or cylindrical wall 208 of laundry basket 120 (e.g., such as perforations 140). Accordingly, laundry appliance 100 may comprise a recirculating process air duct system 226 including the return duct 220 and the intake duct 224. The recirculating process air duct system 226 provides fluid communication of process air between the air inlet 264, the chamber 126, the air outlet 266, and the conditioning system 200. In general, the recirculating air duct system 226, the conditioning system 200, and the basket 120 define the process air flow path 232.

Specifically, moisture laden, heated air is drawn from laundry basket 120 by an air handler, such as a blower fan 222, which generates a negative air pressure within laundry basket 120. The air passes from blower fan 222 via intake duct 224 and then is passed into conditioning system 200. According to the illustrated exemplary embodiment, laundry appliance 100 is a heat pump dryer appliance and thus conditioning system 200 may be or include a heat pump including a sealed refrigerant circuit. Heated process air (with a lower moisture content than was received from laundry basket 120), exits conditioning system 200 and returns to laundry basket 120 by a return duct 220. After the clothing articles have been dried, they are removed from the laundry basket 120 via opening 132.

During the dry wash cycle, the blower fan 222 operates to create a negative pressure in the laundry basket 120 urging a flow of process air. The conditioning system is not energized during the dry wash cycle as the laundry load is dry and removal of moisture from the process air is not required. Further, the flow of process air in the dry wash cycle is not encouraging evaporation of moisture from the laundry load obviating the need for heated process air to be returned to the laundry basket 120.

As shown, laundry appliance 100 may further include one or more air filters 230 (FIG. 3) to collect lint during drying operations. The process air passes through the laundry basket 120 to the intake duct 224 enclosing screen air filter 230, which traps at least fibers and fibrous debris released from the laundry load. More specifically, air filter 230 may be placed into an air flow path 232 defined by laundry basket 120, conditioning system 200, intake duct 224, and return duct 220. Filter 230 may be positioned in the process air flow path 232 and may include a screen, mesh, or other material to capture particulate debris and fibers in the air flow path 232. The location of air filters 230 in laundry appliance 100 as shown in FIG. 3 is provided by way of example only, and other locations may be used as well. According to exemplary embodiments, air filter 230 is readily accessible by a user of the appliance.

In some embodiments, the air filter 230 includes one or more filter media with a pore size, or effective pore size, of about 50 microns to about 200 microns to collect the fibers, hair and other debris from the process air flow passing through the air filter 230. According to some embodiments, the controller 166 may monitor the air filter 230 for indications the filter 230 is approaching, or has reached, its capacity for accumulated fibers and debris. For example, the controller may compare the blower motor 222 current draw to a prescribed current draw, for example the current draw with a known clean filter. If the difference exceeds a predetermined maximum, the controller may determine that the air filter 230 requires cleaning. Alternatively, the controller may sense a pressure difference in the intake duct 224 (FIG. 3) across the air filter 230 to determine if the capacity of the filter has been reached. In still other embodiments, an optical or mechanical accumulation sensor or system may be used to detect the coverage or depth of accumulated debris on the filter. The controller may signal the user of the incremental condition of the filter, or may signal the user when the filter requires cleaning. The signal to the user may be a visual display or audible signal on the control panel (for example on display 164) or may be a visual or audible signal communicated to the consumer device 174. Cleaning the filter of accumulated debris may be accomplished as commonly performed, i.e., by hand or using a vacuum cleaner.

FIG. 3 provides a schematic view of the process air portion of laundry appliance 100 (i.e., the dryer portion) and depicts conditioning system 200 in more detail. FIG. 4 provides a perspective view of tub 124 with conditioning system 200 positioned on top of tub 124. For this embodiment, laundry appliance 100 is a washer and condenser dryer combination appliance 100 and thus conditioning system 200 includes a sealed system 250. Generally, the operational components during a drying operation execute a vapor compression cycle for cooling/dehumidifying moisture laden process air and then heating the dehumidified process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser.

In performing a drying cycle, one or more damp laundry articles LA may be placed within the chamber 126 of laundry basket 120 or may remain in the laundry basket 120 from the previous wash cycle. Hot dry air HDA is supplied to chamber 126 via return duct 220. The hot dry air HDA enters chamber 126 of laundry basket 120 via air inlet 264 defined by laundry basket 120, e.g., through the plurality of holes 140 defined in rear wall 206 and/or cylindrical wall 208 of laundry basket 120 as shown in FIG. 2. The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through an air outlet 266 defined by laundry basket 120 and flows into intake duct 224.

After exiting chamber 126 of laundry basket 120, the warm moisture laden air MLA flows downstream to conditioning system 200. Blower fan 222 moves the warm moisture laden air MLA, as well as the air more generally, through a process air flow path 232 defined by laundry basket 120, conditioning system 200, intake duct 224, and return duct 220. Thus, generally, blower fan 222 is operable to move air through or along the process air flow path 232. The duct system includes all ducts that provide fluid communication (e.g., airflow communication) between air outlet 266 and conditioning system 200 and between conditioning system 200 and air inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA, thereby reducing its temperature. As a result, moisture in the air is condensed on evaporator 252 as liquid water and such condensate water may be drained from conditioning system 200, e.g., using a drain line 262, which is also depicted in FIG. 3.

In embodiments, a condenser tank or a condensate collection tank 270 is in fluid communication with conditioning system 200, e.g., via drain line 262. Collection tank 270 is operable to receive condensate water from the process air flowing through conditioning system 200, and more particularly, condensate water from evaporator 252. A sensor 272 is operable to detect when water within collection tank 270 has reached a predetermined level. Sensor 272 can be any suitable type of sensor, such as a float switch as shown in FIG. 3. Sensor 272 can be communicatively coupled with controller 166, e.g., via a suitable wired or wireless communication link. A drain pump 274 is in fluid communication with collection tank 270. Drain pump 274 is operable to remove a volume of water from collection tank 270 and, for example, discharge the collected condensate to an external drain.

Air passing over evaporator 252 becomes cooler than when it exited laundry basket 120 at air outlet 266. As shown in FIG. 3, cool air CA (cool relative to hot dry air HDA and moisture laden air MLA) flowing downstream of evaporator 252 is subsequently caused to flow across condenser 256, e.g., across coils or tubing thereof, which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing hot dry air HDA for resupply to laundry basket 120 of laundry appliance 100. The hot dry air HDA passes over and around laundry articles LA within the chamber 126 of the laundry basket 120, such that warm moisture laden air MLA is generated, as mentioned above.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the process air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. The flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

Although laundry appliance 100 is depicted and described herein as a washer and condenser dryer combination appliance, the inventive aspects of the present disclosure may be applied to other types of combination washer and dryer laundry appliances with an airflow vented to an environment outside of cabinet 102. For example, in embodiments air inlet 264 comprises a first end fluidly coupled to the chamber 126 and a second end open to an atmosphere outside of the cabinet 102. Similarly, in some embodiments, the air outlet 266 may comprise a first end fluidly coupled to the chamber 126 and a second end open to the external atmosphere. Accordingly, in some embodiments, one or both of the air inlet to the chamber and the air outlet from the chamber may be open to an atmosphere external to the cabinet 102. Further, in other embodiments, laundry appliance 100 can be a condenser dryer that utilizes an air-to-air heat exchanger instead of evaporator 252 and/or an electric heater may be provided instead of condenser 256.

Now that the construction of laundry appliance 100 and the configuration of controller 166 according to exemplary embodiments have been presented, exemplary methods of operating a dryer appliance will be described. In exemplary embodiments, the various method steps as disclosed herein may be performed by controller 166 or a separate, dedicated controller.

Figure 5:
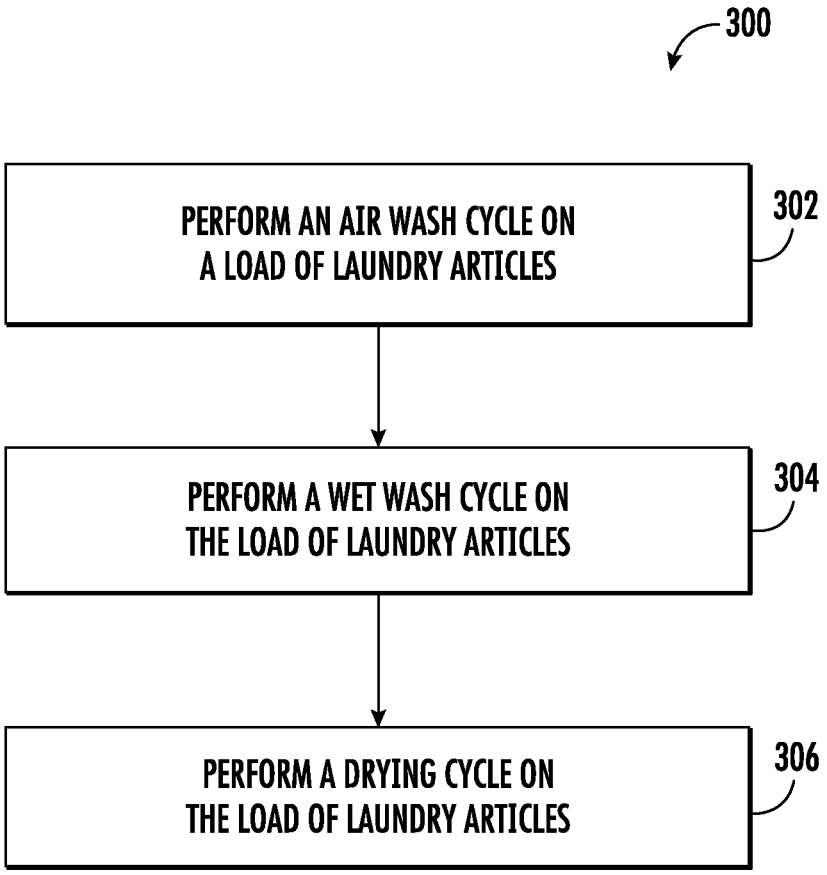
FIG. 5 illustrates a method for operating a laundry appliance in accordance with one embodiment of the present disclosure.

Referring now to FIG. 5, method 300 includes, at step 302, performing an air wash cycle on a load of laundry articles. The air wash cycle comprises operating the fan 222 to circulate a flow of air in the duct system 226. The flow of air follows a flow path comprising at least the air inlet 264, the chamber 126 within the laundry basket 120, and the air outlet 266. In embodiments in which the laundry appliance 100 is vented (i.e., process air is not recirculated), the first end of the air inlet 264 is fluidly coupled to the chamber 126 and the second end of the air inlet 264 is open to the atmosphere outside of the cabinet 102.

The flow path may include the conditioning system 200 or may bypass the conditioning system. In the air wash cycle, process air is not conditioned (i.e., is neither dehumidified nor heated). The process air flows through at least one air filter 230 disposed in the flow path during the air wash cycle. According to embodiments, the air filter includes filter media having a pore size of about 50 microns to about 200 microns to facilitate collection of fibers and debris in the process air.

The fan 222 is operated to move a flow of air at an air flow rate of between about 75 cubic feet per minute (CFM) and about 250 CFM. In some embodiments, the fan 222 may be a variable speed fan with the flow rate proportional to the rotational speed of the fan. For example, a fan speed may be theoretically calculated or empirically determined to correspond to a particular produced flow rate. Accordingly, the controller 166 may operate the fan at a predetermined speed to produce a desired flow rate through the duct system 226.

The air wash cycle may also comprise rotating the laundry basket 120 at a tumble speed for a tumble duration. In embodiments, the tumble speed may be about 10 revolutions per minute (RPM) to about 70 RPM, or about 20 RPM to about 60 RPM, or about 30 RPM to about 50 RPM. The laundry basket may rotate continuously at a first tumble speed and in a first rotation direction for the tumble duration or may be interrupted by dwell periods of between about 3 to 60 seconds during which rotation is suspended or interrupted. The dwell periods may be followed by a second rotation period at a second tumble speed which may be the same or different than the first tumble speed. In the second rotation period, the laundry basket may rotate in a second direction which may be the same or different than the first direction. The tumble duration may be between about 5 minutes and about 15 minutes.

Continuing with the discussion above, the air wash cycle may be used to remove human hair, pet hair, fibrous debris such as grass, fibers and fiber fragments commonly known as lint, and microfibers that are released from the laundry articles, typically in the traditional laundry or wet washing cycle. The presence of hair and fibrous debris may vary with the soil level of the laundry articles. Lint and microfibers, however, may be present in each laundry article regardless of the soil level. Specifically concerning microfibers, typical laundry articles are formed from textile fabrics comprising various fibers twisted into yarns or threads and woven to form the fabric. In the manufacturing process and in typical use, individual fibers may break or fray, leaving microfibers in or on the fabric. In the dry wash cycle, the microfibers may be liberated from the fabric, carried away in the process airflow, and captured by the air filter 230. Similarly, lint may be liberated from the dry laundry load during the air wash cycle and captured by the air filter 230. The collection of dry loose fibers, fibrous debris, hair, and lint may be removed from the air filter 230 using known methods, such as manually or with a vacuum.

In an embodiment, the dry wash cycle may be incorporated into some programmed laundry cycles stored at the controller 166. Selection of such a laundry cycle launches a dry wash cycle before the start of the typical laundry cycle (i.e., wet wash and air dry) in a combination washer/dryer laundry appliance. The user may be provided with the option to deselect the dry wash cycle as desired with appropriate instructions provided to the input selectors 162 or the consumer device 174. According to other embodiments, the dry wash cycle may be a user-selected option to add to an existing laundry cycle stored at the controller 166. The dry wash cycle may be selected through manipulation of the input selectors 162 or through manipulation of the consumer device 174. In some embodiments, voice commands may be given to the controller 166 through a microphone at the control panel 162. Alternatively or additionally, voice commands may be provided to the consumer device 174.

Following the dry wash cycle of 302, a wet wash cycle is performed on the load of laundry articles at 304. The wet wash cycle follows, and may immediately follow, the dry wash cycle, meaning that the wet wash cycle is the next laundry operation and it may occur without delay after the dry wash cycle is completed. The wet wash cycle introduces wash fluid to the laundry load in the laundry basket 120, agitates the laundry load in the wash fluid, extracts the wash fluid from the laundry load, rinses the laundry load, and extracts the rinse liquid from the laundry load. This process may be repeated one or more times as controlled by the controller 166 executing a stored or user-created wet wash cycle.

At the conclusion of the wet wash cycle of 304, at 306 a drying cycle is performed on the load of laundry articles. Continuing with the discussion above, the laundry appliance 100 may be a combination washer/dryer laundry appliance. As such, the laundry appliance 100 may include a conditioning system 200 and a duct system 226. In embodiments having a recirculating process air flow path, the conditioning system 226 conditions the flow of process air to facilitate drying of the laundry load following the wet wash cycle. The conditioning system 226 may include one or both of a dehumidification section (e.g., evaporator 252) and a heating section (e.g., condenser 256) to adjust qualities of the process air to better dry the laundry load. The duct system 226 is provided for routing the process air between the conditioning system 200 and the chamber 126 and from the chamber 126 back to the conditioning system 200.

In some embodiments, the process air may be moved from an environment outside of the cabinet 102 to the conditioning system 200 for dehumidification or heating or both dehumidification and heating. After conditioning, the process air flows to the tub 124 and into the chamber 126 through perforations 140 in the laundry basket 120. As the laundry basket 120 tumbles, the flow of process air facilitates evaporation of the water from the laundry load into the process air. The process air flows through the chamber 126 to outlet 266 and air filter 230 for trapping any additional fibers released during the drying cycle. After filtering, the process air may be exhausted to the external atmosphere.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A laundry appliance comprising:

a tub positioned within a cabinet;

a basket supported for rotation within the tub, the basket defining a chamber for receipt of laundry articles for washing and drying;

a drive motor operatively coupled to the basket;

an air duct system providing fluid communication between an air inlet, the chamber, and an air outlet, wherein the air inlet, the chamber, and the air outlet define an air flow path;

an air filter within the air flow path;

a fan operable to move a flow of air through the air flow path; and a controller operably coupled to the drive motor and the fan, the controller being configured to:

perform an air wash cycle on a load of laundry articles, wherein the air wash cycle comprises:

operating the fan to circulate air within the air duct system; and rotating the basket at a tumble speed for a tumble duration, wherein rotating the basket comprises a first rotation period at the tumble speed of between about 30 revolutions per minute and about 50 revolutions per minute, followed by a dwell period of between about 3 to 60 seconds during which rotation is suspended, followed by a second rotation period at the tumble speed of between about 30 revolutions per minute and about 50 revolutions per minute; and perform a wet wash cycle on the load of laundry articles, wherein the wet wash cycle comprises introducing wash fluid into the tub;

wherein the wet wash cycle is performed immediately following the air wash cycle.

2. The laundry appliance of claim 1, wherein a first end of the air inlet is fluidly coupled to the chamber and a second end of the air inlet is open to an atmosphere outside of the cabinet.

3. The laundry appliance of claim 1, wherein a first end of the air outlet is fluidly coupled to the chamber and a second end of the air outlet is open to an external atmosphere.

4. The laundry appliance of claim 1, wherein:

a first end of the air inlet is fluidly coupled to the chamber and a first end of the air outlet is fluidly coupled to the chamber; and a second end of the air inlet is fluidly coupled to a second end of the air outlet.

5. The laundry appliance of claim 4, further comprising a conditioning system wherein the second end of the air inlet is fluidly coupled to the second end of the air outlet through the conditioning system.

6. The laundry appliance of claim 1, wherein the fan is operated to move a flow of air at a flow rate of between about 75 cubic feet per minute and about 250 cubic feet per minute.

7. The laundry appliance of claim 1, wherein the tumble speed is between about 30 revolutions per minute and about 50 revolutions per minute.

8. The laundry appliance of claim 1, wherein rotating the basket comprises rotating the basket in a first direction, pausing the rotation, and rotating the basket in a second direction.

9. The laundry appliance of claim 1, wherein the tumble duration is between about 5 to about 15 minutes.

10. The laundry appliance of claim 1, wherein the air filter comprises filter media having a pore size of between about 50 microns to about 200 microns.

11. A method of operating a laundry appliance, the laundry appliance comprising a basket defining a chamber, the basket supported for rotation within a tub, a drive motor operatively coupled to the basket, an air duct system providing fluid communication between an air inlet, the chamber, and an air outlet, wherein the air inlet, the chamber, and the air outlet define an air flow path, and a fan operable to move a flow of air through the air flow path, the method comprising:

performing an air wash cycle on a load of laundry articles, wherein the air wash cycle comprises:

operating the fan to circulate air within the air duct system; and rotating the basket at a tumble speed for a tumble duration, wherein rotating the basket comprises a first rotation period at the tumble speed of between about 30 revolutions per minute and about 50 revolutions per minute, followed by a dwell period of between about 3 to 60 seconds during which rotation is suspended, followed by a second rotation period at the tumble speed of between about 30 revolutions per minute and about 50 revolutions per minute; and performing a wet wash cycle on the load of laundry articles, wherein the wet wash cycle comprises introducing wash fluid into the tub;

wherein the wet wash cycle is performed immediately following the air wash cycle.

12. The method of claim 11, wherein the fan is operated to move a flow of air at a flow rate of between about 75 cubic feet per minute and about 250 cubic feet per minute.

13. The method of claim 11, wherein rotating the basket comprises continuously rotating the basket at the tumble speed of about 30 revolutions per minute and about 50 revolutions per minute.

14. The method of claim 13, wherein the tumble duration is between about 5 minutes and about 15 minutes.

15. The method of claim 11, wherein rotation is in a first direction during the first rotation period and a second direction during the second rotation period.

16. The method of claim 11, wherein the laundry appliance further comprises a conditioning system fluidly coupled to the air inlet; and further wherein the method comprises a drying cycle in which the flow of air comprises conditioned air.

17. The method of claim 16, wherein the conditioning system is fluidly coupled to the air outlet such that the air flow path includes the conditioning system.

* * * * *